US008061336B2

(12) United States Patent
Takeuchi

(10) Patent No.: US 8,061,336 B2
(45) Date of Patent: Nov. 22, 2011

(54) PCV SYSTEM FOR V-TYPE ENGINE

(75) Inventor: Nobutaka Takeuchi, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 714 days.

(21) Appl. No.: 12/085,945

(22) PCT Filed: Dec. 27, 2006

(86) PCT No.: PCT/IB2006/003779

§ 371 (c)(1),
(2), (4) Date: Jun. 3, 2008

(87) PCT Pub. No.: WO2007/074384

PCT Pub. Date: Jul. 5, 2007

(65) Prior Publication Data

US 2009/0159056 A1 Jun. 25, 2009

(30) Foreign Application Priority Data

Dec. 28, 2005 (JP) ..... 2005-376773

(51) Int. Cl.
*F01M 13/00* (2006.01)
*F01M 13/04* (2006.01)

(52) U.S. Cl. ..... 123/572

(58) Field of Classification Search ..... 123/572–574, 123/41.86, 54.4
See application file for complete search history.

(56) References Cited

U.S. PATENT DOCUMENTS

| | | | | |
|---|---|---|---|---|
| 2,996,050 | A * | 8/1961 | Caris | 123/41.72 |
| 3,949,719 | A | 4/1976 | Bellanca et al. | |
| 4,494,494 | A * | 1/1985 | Yahiro et al. | 123/54.6 |
| 4,844,032 | A | 7/1989 | Groeger et al. | |
| 5,069,192 | A * | 12/1991 | Matsumoto et al. | 123/572 |
| 5,115,791 | A | 5/1992 | Dore | |
| 6,460,524 | B2 * | 10/2002 | Kimura | 123/572 |

FOREIGN PATENT DOCUMENTS

| | | |
|---|---|---|
| DE | 34 14 710 A1 | 10/1984 |
| EP | 0 287 756 A2 | 10/1988 |
| EP | 0 466 542 A1 | 1/1992 |
| GB | 2 134 976 A | 8/1984 |
| JP | U 59-100910 | 7/1984 |
| JP | A 59-188019 | 10/1984 |
| JP | U 63-108508 | 7/1988 |
| JP | A 63-277811 | 11/1988 |
| JP | U 64-29211 | 2/1989 |

(Continued)

*Primary Examiner* — M. McMahon
(74) *Attorney, Agent, or Firm* — Oliff & Berridge, PLC

(57) ABSTRACT

The invention provides a PCV system for a V-type engine, where an oilmist extraction port, through which oilmist to be supplied to an oil separator is taken out from the engine, is formed at a position corresponding to the lateral center of the top portion of a chain case of the engine, and the oil separator has an oil discharge hole, and is connected to a PCV valve. A rib, which extends from the floor wall of the oil separator toward a wall opposite to the floor wall, is arranged inside the oil separator. The rib forms a dead-end portion that is open in the direction opposite to the direction toward the PCV valve side, and forms a dead-end in the direction toward the PCV valve side. An oil return passage connected to the oil discharge hole is provided with a container portion.

17 Claims, 5 Drawing Sheets

FOREIGN PATENT DOCUMENTS

| | | |
|---|---|---|
| JP | U 2-85813 | 7/1990 |
| JP | A 5-272325 | 10/1993 |
| JP | Y2 8-005298 | 2/1996 |
| JP | A 11-200831 | 7/1999 |
| JP | A 2004-211644 | 7/2004 |
| JP | K 2004-507820 | 12/2004 |

* cited by examiner

PCV SYSTEM FOR V-TYPE ENGINE

BACKGROUND OF THE INVENTION

The disclosure of Japanese Patent Application No. 2005-376773 filed Dec. 28, 2005, including the specification, drawings and abstract, is incorporated herein by reference in its entirety.

1. Field of the Invention

The invention relates to a PCV (positive crankcase ventilation) system for a V-type engine (an engine in which the cylinders are arranged in two separate banks that form a V-shape therebetween).

2. Description of the Related Art

A PCV system separates oilmist from blowby gas using an oil separator, and supplies the oilmist-free blowby gas to an intake system of an engine.

Japanese Patent Application Publication No. 2004-211644 (JP-A-2004-211644) describes providing an oil separator in the upper area of the space between the right and left banks in a V-type engine.

When a surge tank of an intake system is arranged in the upper area of the space between the right and left banks, if an oil separator is provided in the dead space below the surge tank to effectively utilize the space, the oil separator needs to be short in height and flat in order to avoid contact between the oil separator and the surge tank.

FIGS. 7 and 8 show the case where an oil separator 1 that is short in height is arranged in the manner in which the portion, at which the oil separator is connected to the PCV valve, faces the front of a vehicle. In the oil separator 1 that is short in height, the height of a rib 2, on which the blow-by gas containing oilmist impinges so that liquid and gas are separated from each other, is low. Accordingly, an oilmist inlet 3 needs to be formed at an appropriate position so that the size of grains of the oilmist flowing into the oilmist inlet 3 becomes appropriate for gas-liquid separation, or the rib 2 needs to be appropriately arranged so that the length of a blowby gas passage in the oil separator is sufficiently long in order to effectively separate liquid and gas from each other.

If the oil separator 1 that is short in height receives an inertia force due to a sudden stop of the vehicle or if the engine tilts, for example, when the vehicle is running on a downhill slope, oil 4, which has been separated from gas and is on the floor of the oil separator 1 may easily enter a PCV valve 5 provided at the front end of the oil separator 1, flow into an intake manifold, and be burned in the engine. As a result, white smoke may be produced.

In document DE 34 14 710, an engine is disclosed which comprises a valve and an oil separator. Connecting holes connecting the oil separator and a crank case, are formed at the cylinder block. In document EP 0 287 756, an de-aerating means having an oil separator, is placed at the crank case between the cylinders.

SUMMARY OF THE INVENTION

In light of the above-described circumstances, the invention provides a PCV system for a V-type engine, in which an oil separator is configured so that gas-liquid separation is promoted. The invention also provides a PCV system for a V-type engine in which an oil separator is configured so that gas-liquid separation is promoted and the oil in the oil separator is prevented from entering an intake manifold.

In accordance with the present invention, a PCV system for a V-type engine comprises the features of the independent claims 1, 2, or 10. Further advantageous developments are subject matter of the claims 3 to 9.

(1) An aspect of the invention relates to a PCV system for a V-type engine, where an oilmist extraction port, through which oilmist to be supplied to an oil separator is taken out from the engine, is formed at a position corresponding to the lateral center of the top portion of a chain case of the engine, and the oil separator has an oil discharge hole, and is connected to a PCV valve.

(2) In the PCV system according to the above-described aspect of the invention, the oil separator may be arranged at a position between right and left banks of the V-type engine and below a surge tank, and an inlet, through which the oilmist from the oilmist extraction port is introduced into the oil separator, may be formed at an end portion of the oil separator.

(3) In the PCV system according to the above-described aspect of the invention, the oil discharge hole may be used to return oil, which has been separated from gas and liquefied in the oil separator, to the engine, and the oil discharged hole may be formed in an end portion of the oil separator, the end portion being on the opposite side of the chain case.

(4) In the PCV system according to the above-described aspect of the invention, the PCV valve may be used to return blowby gas, which has been separated from liquid in the oil separator, to an intake system of the engine, and the PCV valve may be provided at an end portion of the oil separator, the end portion being on the chain case side.

(5) In the PCV system according to the above-described aspect of the invention, the oil separator may have a floor wall; a rib, which extends from the floor wall of the oil separator toward a wall opposite to the floor wall, may be arranged inside the oil separator; the rib may form a dead-end portion that is open in the direction opposite to the direction toward the PCV valve side, and form a dead-end in the direction toward the PCV valve side; and the dead-end portion may hold back oil flowing on the floor wall of the oil separator toward the PCV valve side when the engine is tilted in the manner in which an end of the oil separator, at which the PCV valve is arranged, is lower than the other end of the oil separator.

(6) In the PCV system according to the above-described aspect of the invention, a communication passage, through which the oil that has been separated from gas and liquefied in the oil separator flows to the oil discharge hole, may be formed between an end portion of the rib, at which the dead-end portion is open, and a side wall of the oil separator, which faces the end portion, and a guide rib, which guides the oil that has been separated from the gas and liquefied in the oil separator to the communication passage, may be arranged at a position closer to the oilmist extraction port than the communication passage is.

(7) In the PCV system according to the above-described aspect of the invention, the oil separator may have a floor wall, the floor wall of the oil separator may have a first floor wall portion that is close to the oil discharge hole and a second floor wall portion that is close to the PCV valve, and the first floor wall portion may be level with or lower than the second floor wall portion.

(8) In the PCV system according to the above-described aspect of the invention, a new air introduction passage may be connected to an oil return passage connected to the oil discharge hole.

(9) In the PCV system according to the above-described aspect of the invention, new air from two banks of the V-type engine may be introduced in the new air introduction passage.

(10) In the PCV system according to the above-described aspect of the invention, an oil return passage connected to the oil discharge hole may be provided with a container portion.

In the PCV system (1), the oilmist extraction port, through which the oilmist to be supplied to the oil separator is taken out from the engine, is formed at the position corresponding to the lateral center of the top portion of the chain case of the engine. Accordingly, the blowby gas that contains the oil mist having grains in an appropriate size for gas-liquid separation is introduced into the oil separator. As a result, gas-liquid separation is promoted.

In the PCV system (2), the oil separator is arranged at a position between the right and left banks of the V-type engine and below the surge tank. Accordingly, the dead space is efficiently utilized.

In the PCV system (3), the oil discharge hole is on the opposite side of the blowby gas inlet. Accordingly, the oil return passage is arranged independently of the arrangement of the chain, etc. As a result, it is easier to route the oil return passage.

In the PCV valve system (4), the PCV valve is arranged at the end portion of the oil separator, the end portion being on the chain case side. Accordingly, a U-turn passage that extends from the blowby gas inlet toward the oil discharge hole, turns back at a U-turn position, and extends toward the PCV valve side is employed as the blowby gas passage. Employing such U-turn passage increases the length of the passage, which is advantageous to gas-liquid separation.

In the PCV valve system (5), the rib is open in the direction opposite to the direction toward the PCV valve side, and forms the dead-end portion that forms a dead-end in the direction toward the PCV valve side. Accordingly, if the oil separator receives an inertia force due to a sudden stop of the vehicle or if the engine tilts, for example, when the vehicle is running on a downhill slope, and, therefore, the oil in the oil separator starts flowing toward the front side of the vehicle, the flow of the oil toward the front side of the vehicle is blocked by the rib, and the oil is held and collected in the dead-end portion until the oil level exceeds the upper end of the rib. As a result, it is possible to prevent the situation where the oil in the oil separator enters the intake manifold of the engine and is burned in the engine and white smoke is then produced.

In the PCV system (6), the communication passage is formed between the end portion of the rib, at which the dead-end portion is open, and the side wall of the oil separator, which faces the end portion, and the guide rib, which guides the oil to the communication passage, is arranged at the position closer to the oilmist extraction port (namely, the blowby gas inlet of the oil separator) than the communication passage is. Accordingly, the oil present upstream of the guide rib in the direction in which the blowby gas flows is efficiently guided to the oil discharge hole by the guide rib.

In the PCV system (7), the first floor wall portion that is close to the oil discharge hole is level with or lower than the second floor wall portion that is close to the PCV valve. Accordingly, the oil which has been separated from the gas flows to the first floor wall portion, and then flows in the oil discharge hole efficiently. Also, because the first floor wall portion is lower than the other floor portion, the oil level is low with respect to the upper end of the rib. Accordingly, even if the oil separator receives an inertia force due to a sudden stop of the vehicle or if the engine tilts, for example, when the vehicle is running on a downhill slope, and, therefore, the oil in the oil separator starts flowing toward the front side of the vehicle, it is difficult to for the oil to overflow the rib.

In the PCV system (8), the new-air introduction passage is connected to the oil return passage connected to the oil discharge hole. Accordingly, the new air in a cylinder head cover is introduced in the oil separator through the oil discharge hole. As a result, formation of sludge in the oil separator is suppressed.

In the PCV system (9), the new air from the two banks of the V-type engine is introduced in the new air introduction passage. This structure matches the arrangement of the oil separator between the two banks.

In the PCV system (10), the oil return passage connected to the oil discharge hole is provided with the container portion. Accordingly, even if the oil from the oil discharge hole starts flowing back, it is possible to absorb the backflow of the oil in the container portion. As a result, the oil is prevented from entering the oil separator.

BRIEF DESCRIPTION OF THE DRAWINGS

The features, advantages thereof, and technical and industrial significance of the invention will be better understood by reading the following detailed description of an example embodiment of the invention, when considered in connection with the accompanying drawings, in which.

DETAILED DESCRIPTION OF THE EXAMPLE EMBODIMENT

Figure 1:
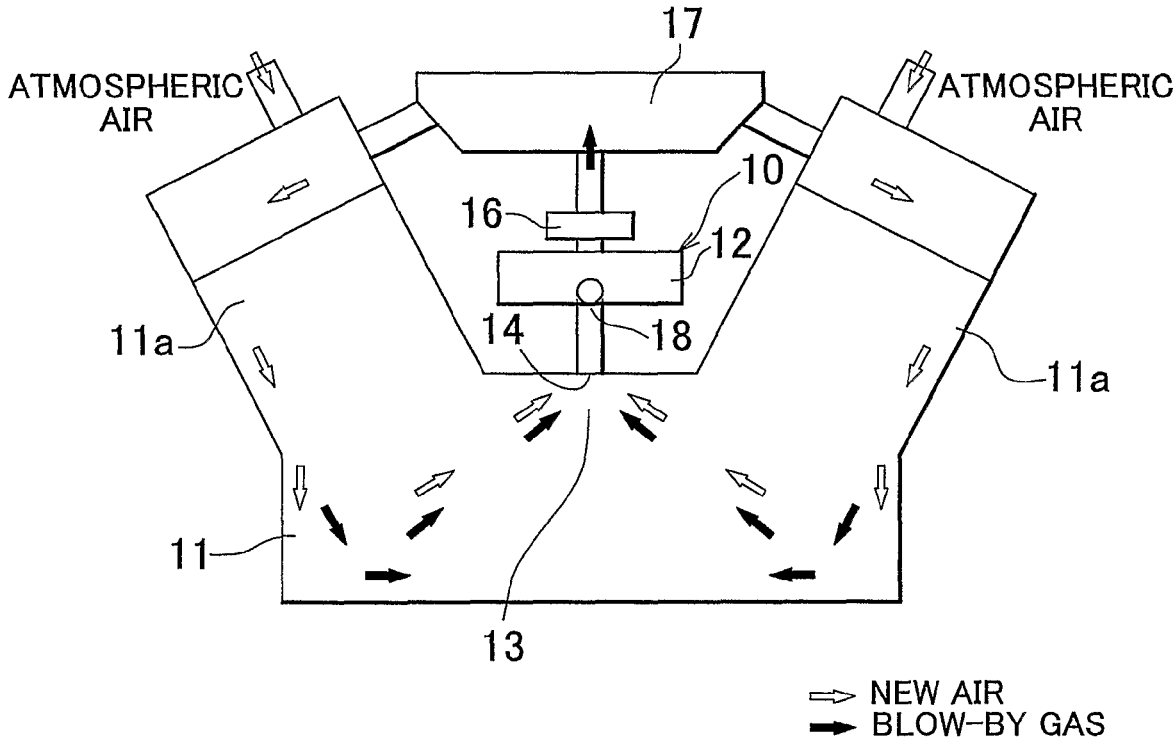
FIG. 1 is the front view of a PCV system for a V-type engine according to an embodiment of the invention.

In the following description and the accompanying drawings, the invention will be described in more detail with reference to an example embodiment.

As shown in FIGS. 1 to 5, a PCV system 10 for a V-type engine 11 according to an embodiment of the invention includes a PCV valve 16; an oil separator 12 which has an oil discharge hole 15, is connected to the PCV valve 16, and is provided in the space between two banks 11*a*; an oilmist extraction port 14, which is formed at a position corresponding to the lateral center of the top portion of a chain case 13 and through which the oilmist in the engine is taken into the oil separator 12, etc. The PCV system 10 is mounted on the V-type engine 11. Examples of V-type engines include a V-type engine in which the cylinders are arranged in two separate banks set at a horizontal angle (an angle at or around 180 degrees).

The chain case 13 is provided at one of the longitudinal-direction-ends of the engine 11. The chain case 13 is shared by the two banks 11*a*. The oilmist extraction port 14, through which the oilmist in the engine is taken into the oil separator 12, is formed at the position corresponding to the center (in the lateral direction) of the top portion of the chain case 13. The oilmist extraction port 14 may be formed in a cylinder block or the chain case 13.

Figure 2:
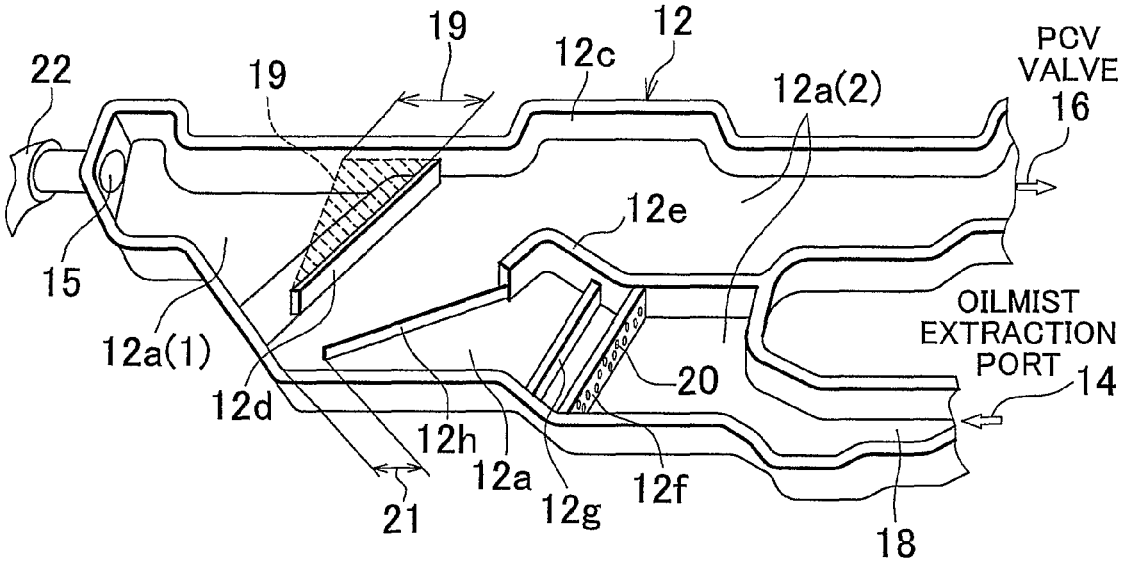
FIG. 2 is the perspective view of an oil separator of the PCV system for a V-type engine according to the embodiment of the invention, with the ceiling wall removed.
Figure 3:
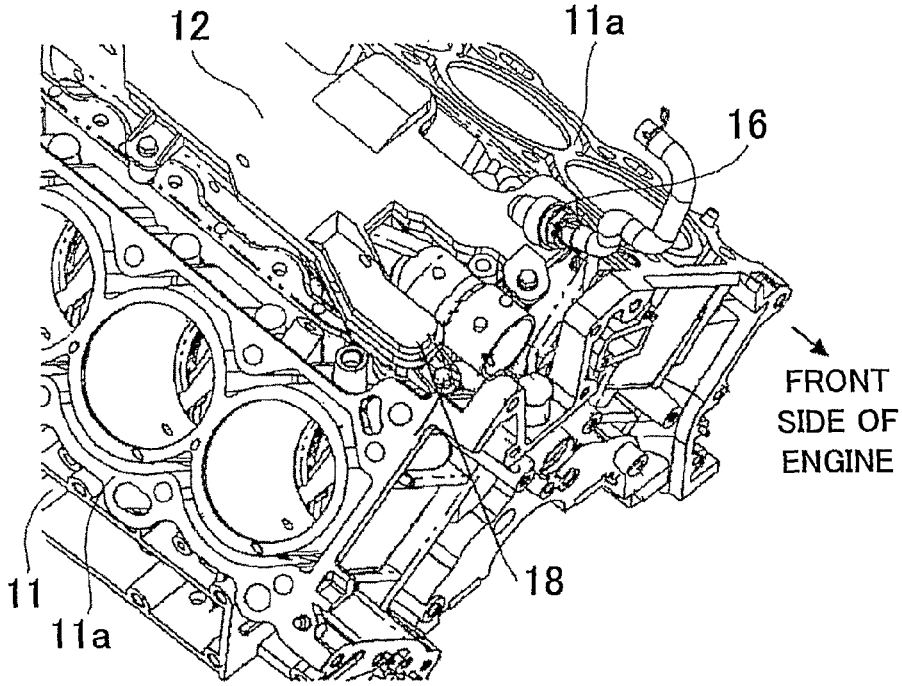
FIG. 3 is the perspective view of the front portion of the PCV system for a V-type engine according to the embodiment of the invention.
Figure 4:
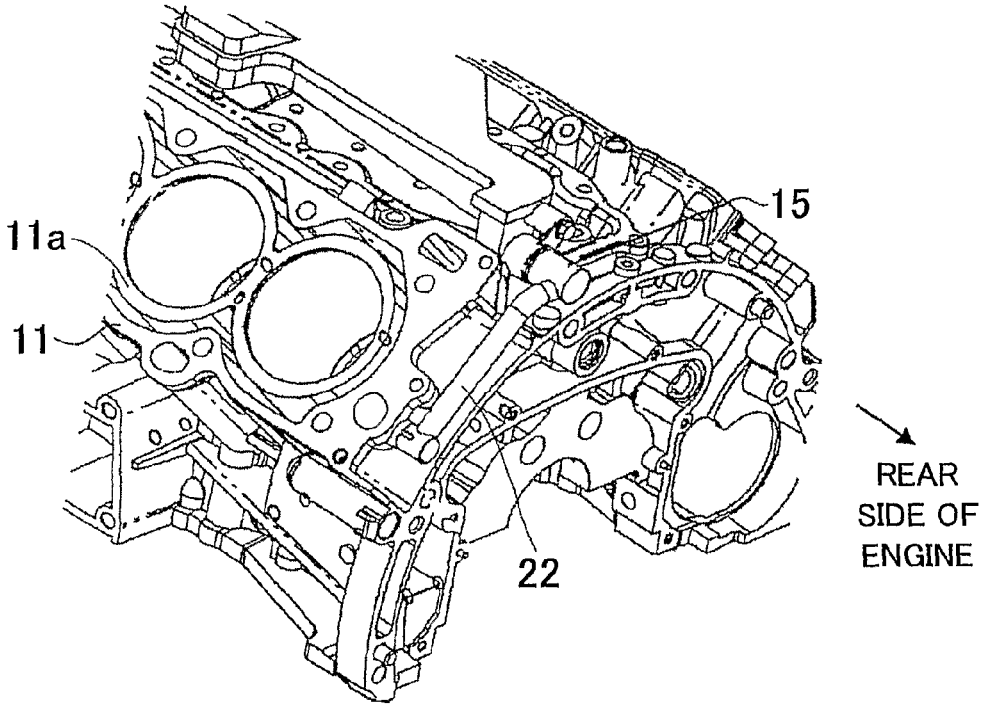
FIG. 4 is the perspective view of the rear portion of the PCV system for a V-type engine according to the embodiment of the invention.

The oil separator 12 is formed of an oil separator case that is open at the top and that includes a floor wall 12*a* and a side wall 12*c*; and a lid that includes a ceiling wall 12*b* which covers the oil separator case from above. FIG. 2 shows the oil separator 12 (the oil separator case) with the lid removed. An oil discharge hole 15 is formed in the oil separator 12, and the oil separator 12 is connected to the PCV valve 16.

The oil separator 12 is provided at a position between the right and left banks 11*a* of the V-type engine 11 and below a surge tank 17. A blowby gas inlet 18, through which oilmist (blowby gas containing oil mist) is introduced into the oil separator 12, is formed at the end of the oil separator 12. The blowby gas inlet 18 is connected to the oilmist extraction port 14 formed in the engine.

The oil, which has been separated from the gas in the oil separator 12, is returned to the internal combustion engine through the oil discharge hole 15. The oil discharge hole 15 is formed in the oil separator 12 at the end opposite to the chain case 13. The PCV valve 16 is used to return the blowby gas, which has been separated from the liquid in the oil separator 12, to an intake system of the internal combustion engine. The PCV valve 16 is provided to the oil separator 12 at the end at which the chain case 13 is provided.

The oil separator 12 is arranged substantially horizontally. The oil separator has a flat shape, and includes the floor wall 12*a*, the ceiling wall 12*b* that is opposed to the floor wall 12*a* in the vertical direction, and the side wall 12*c* that extends in the substantially vertical direction between the floor wall 12*a* and the ceiling wall 12*b*. A rib 12*d* is arranged inside the oil separator 12. The rib 12*d* extends from the floor wall 12*a* toward the wall opposed to the floor wall 12*a* (e.g. the ceiling wall 12*b*). The rib 12*d* may extend up to the ceiling wall 12*b*. Alternatively, the rib 12*d* may extend up to a position between the floor wall 12*a* and the ceiling wall 12*b*. When the rib 12*d* extends up to a position between the floor wall 12*a* and the ceiling wall 12*b*, there is a clearance, through which the air passes, between the upper end of the rib 12*d* and the ceiling wall 12*b*.

As is clear from the plan view of the oil separator 12, there is a dead-end portion 19 that is formed by the rib 12*d* and the side wall 12*c* of the oil separator 12. The dead-end portion 19 is open in the direction opposite to the direction toward the PCV valve 16 side, and forms a dead-end in the direction toward the PCV valve 16 side. As is clear from the side view of the oil separator 12, when the rib 12*d* extends up to a position between the floor wall 12*a* and the ceiling wall 12*b*, the air passes through the clearance between the upper end of the rib 12*d* and the ceiling wall 12*b*. Accordingly, the dead-end portion 19 does not form a dead-end in the direction toward the PCV valve 16 side, at a position between the upper end of the rib 12*d* and the ceiling wall 12*b*. When the engine is tilted in the manner in which the end of the oil separator 12, at which the PCV valve 16 is provided, is lower than the other end, the dead-end portion 19 holds back the oil that flows on the floor wall 12*a* of the oil separator 12 toward the PCV valve 16 side.

More specifically, when the rib 12*d* extends up to a position between the floor wall 12*a* and the ceiling wall 12*b*, the dead-end portion 19 dams up the oil flowing on the floor wall 12*a* toward the PCV valve 16 side until the oil level reaches the upper end of the rib 12*d*. When the rib 12*d* extends up to the ceiling wall 12*b*, the dead-end portion 19 dams up the oil flowing on the floor wall 12*a* toward the PCV valve 16 side until the oil spills over the dead-end portion 19.

Figure 5:
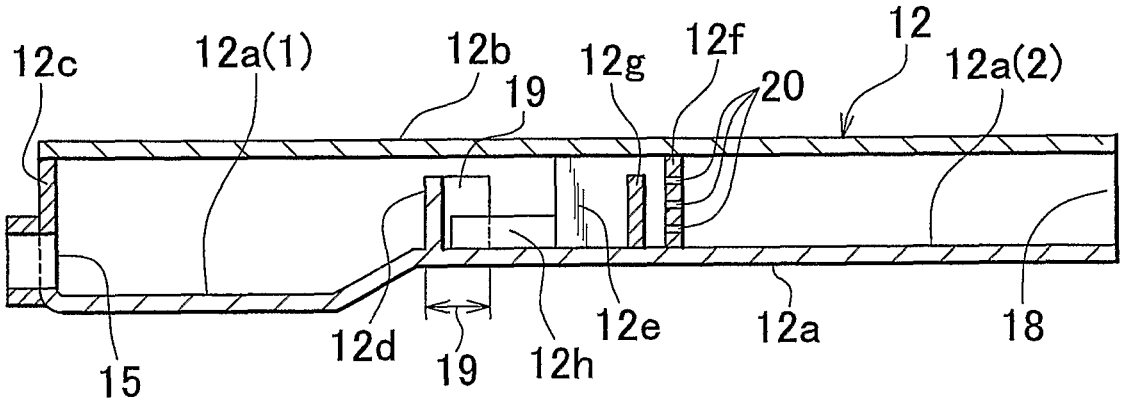
FIG. 5 is the cross-sectional view of the oil separator of the PCV system for a V-type engine according to the embodiment of the invention.

The floor wall 12*a* of the oil separator 12 has a first floor wall portion 12*a*(1) that is close to the oil discharge hole 15, and a second floor wall portion 12*a*(2) that is close to the PCV valve 16. As shown in FIG. 5, the first floor wall portion 12*a*(1) is level with or lower than the second wall portion 12*a*(2). The dead-end portion 19 is within the first floor wall portion 12*a*(1). The oil discharge hole 15 is formed at a position corresponding to the lowest position of the first floor wall portion 12*a*(1) in the vertical direction. With this structure, the oil on the first floor wall portion 12*a*(1) flows into the oil discharge hole 15 under its own weight. With this structure, the oil, which has been separated from the gas in the oil separator 12 and is currently on the floor wall 12*a* in the form of liquid, flows from the second floor wall portion 12*a*(2) toward the first floor wall portion 12*a*(1), flows from the oil discharge hole 15 through an oil discharge passage, and is finally returned to an oil pan of the engine.

Instead of the structure described above, the rib 12*d* may be formed of a canopy-like member that extends upward from the boundary between the first floor wall portion 12*a*(1) and the second floor wall portion 12*a*(2), and that hangs over the first floor wall portion 12*a*(1). Then, the dead-end portion 19 may be formed of the space between the first floor wall portion 12*a*(1) and the canopy-shaped rib 12*d*.

In addition to the rib 12*d*, a partition wall 12*e*, a guide rib 12*h*, and impinging plates 12*f*, 12*g* are arranged inside the oil separator 12. The oil separator 12 has the partition wall 12*e* that extends from the side wall 12*c* at a position between the blowby gas inlet 18 and the PCV valve 16 toward the oil discharge hole 15. The partition wall 12*e* extends up to a position before the rib 12*d*. The partition wall 12*e* defines a U-turn passage in the oil separator 12. The partition wall 12*e* extends in the oil separator 12 over the overall height of the oil separator 12. Forming the U-turn passage increases the length of the passage. This is advantageous to gas-liquid separation.

The two impinging plates 12*f*, 12*g*, which are apart from each other, are provided in the U-turn passage in the oil separator 12. The impinging plates 12*f*, 12*g* are arranged in the U-turn passage at positions upstream of the U-turn portion in the direction in which the blowby gas flows. Multiple through-holes 20 are formed in the impinging plate 12*f* arranged upstream of the impinging plate 12*g*. The flow of the blowby gas passing through the through-holes 20 is reduced, so that the flow rate of the blowby gas passing through the though holes 20 is increased. Thus, the oilmist grains and the air are separated from each other using the difference in flow speed between the mist and the air flow. The oilmist grains, of which the flow speed has been increased by passing through the through-holes 20 formed in the upstream-side impinging plate 12*f*, impinge on the downstream-side impinging plate 12*g* to be liquefied, and drop on the floor. The oil, which has been separated from the gas by the impinging plates l2*f*, 12*g* and accumulated on the floor in the form of liquid, flows down due to the flow of the blowby gas.

A communication passage 21 is formed between the end portion of the rib 12*d* at which the dead-end portion 19 is open and the side wall 12*c* which faces the end portion. The oil, which has been separated from the gas by the impinging plates 12*f*, 12*g* of the oil separator 12 and which flows downward on the floor, flows to the oil discharge hole 15 through the communication passage 21. A guide rib 12*h* is provided at a position closer to the blowby gas inlet 18 than the communication passage 21 is. The guide rib 12*h* guides the oil, which has been separated from the gas by the impinging plates 12*f*, 12*g* of the oil separator 12 and which flows downward on the floor, toward the communication passage 21. The guide rib 12*h* extends from the end of the partition wall 12*e* toward the communication passage 21. Because the guide rib 12*h* is equal to or shorter than the rib 12*d* in height, the guide rib 12*h* does not block the flow of blowby gas which has been separated from the oilmist.

Figure 6:
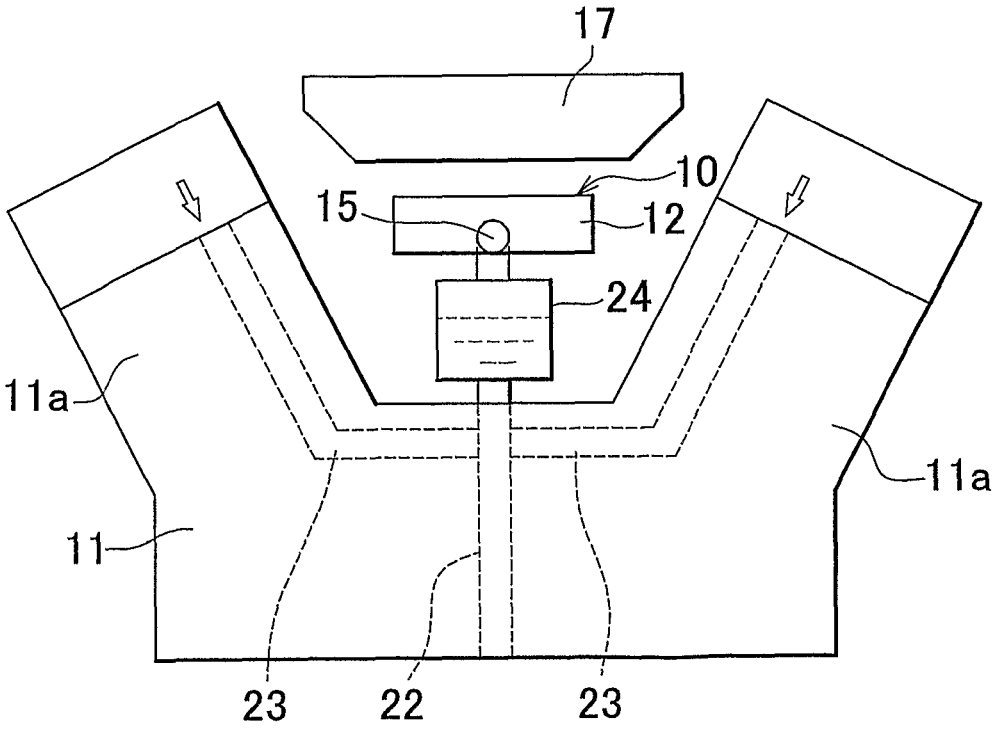
FIG. 6 is the rear view showing the PCV system for a V-type engine according to the embodiment of the invention, and also showing an oil return passage, a new air introduction passage, and a container portion.
Figure 7:
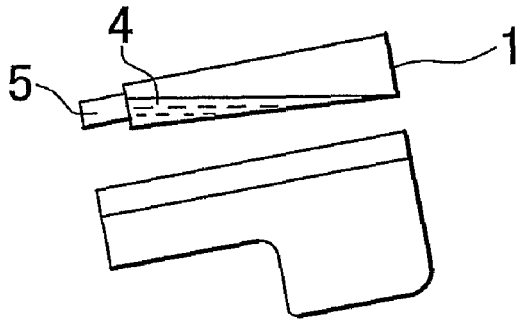
FIG. 7 PRIOR ART
FIG. 7 is the side view of a conventional PCV system for a V-type engine.
Figure 8:
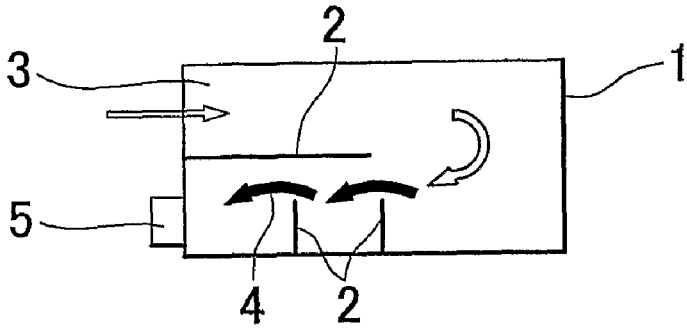
FIG. 8 PRIOR ART
FIG. 8 is the plan view of an oil separator of the conventional PCV system for a V-type engine.

As shown in FIG. 6, an oil return passage 22 is connected to the oil discharge hole 15. A new air introduction passage 23 is connected to the oil return passage 22. Through the new air introduction passage 23, the new air in a cylinder head cover is introduced in the oil separator 12 using a negative pressure in an intake manifold. The blowby gas contains NOx, and sludge is formed if NOx enters the oil separator 12. Accordingly, the new air in the cylinder head cover is introduced in the oil separator 12 to dilute the blowby gas with the new air. As a result, the concentration of NOx is reduced, and, therefore, formation of sludge is suppressed.

The oil return passage 22 connected to the oil discharge hole 15 is provided with a container portion (an extension chamber) 24. If there is a large amount of blowby gas in the engine, the blowby gas may flow back through the oil return passage 22 against the oil flowing down through the oil return passage 22, and the oil may flow back through the oil return passage 22 along with the blowby gas. Even in such a case, if the oil return passage 22 is provided with the container portion 24, it is possible to store the oil in the container portion 24 to absorb the backflow of the oil. As a result, the oil is prevented from entering the oil separator 12. Even if the oil is accumulated in the container portion 24, the new air from the new air passage 23 comes up in the oil in a form of bubbles, and flows in the oil separator 12. The new air from the two banks 11*a* of the V-type engine 11 is introduced into the new air passage 23.

Next, the effects of the embodiment of the invention will be described. Because the oilmist extraction port 14, through which the oilmist in the engine is introduced into the oil separator 12, is formed at the position corresponding to the center (in the lateral direction) of the top portion of the chain case 13 (the oilmist extraction port 14 may be formed in the cylinder block or the chain case 13). Accordingly, the blowby gas, which contains oilmist having mist grains in an appropriate size for gas-liquid separation, is introduced into the oil separator 12. As a result, gas-liquid separation is promoted. If the mist grains are excessively small, it is difficult to separate gas and liquid from each other. However, the size of the mist grains becomes appropriate for gas-liquid separation at the position corresponding to the center of the top portion of the chain case 13 due, for example, to agitation by the chain. Accordingly, the position corresponding to the center of the top portion of the chain case 13 is the optimum position for the oilmist extraction port 14, with regard to gas-liquid separation.

In addition, because the oil separator 12 is provided at a position between the right and left banks 11*a* of the V-type engine 11 and below the surge tank 17, the oil separator 12 is efficiently arranged in the dead space between the right and left banks 11*a* of the V-type engine 11. Further, because the oil separator 12 receives heat from the V-type engine 11, freezing of the oil separator 12 is prevented.

In addition, because the oil discharge hole 15 is formed on the opposite side of the blowby gas inlet 18, the oil return passage 22 is arranged independently of the arrangement of the chain, etc. This makes it easier to route the oil return passage 22. Because the PCV valve 16 is provided at the end of the oil separator 12 on the chain case side, a U-turn passage that extends from the blowby gas inlet 18 toward the oil discharge hole 15 in the longitudinal direction of the oil separator 12, turns back at a position near the rib 12*d*, and extends toward the PCV valve 16 side is employed as the blowby gas passage. As compared with a non-U-turn passage, the length of the passage is long and, therefore, the amount of mist, which adheres to the inner faces of the walls and is then liquidized, increases. This is advantageous to gas-liquid separation.

In addition, the rib 12*d* is open in the direction opposite to the direction toward the PCV valve 16 side, and forms the dead-end portion 19 that forms a dead-end in the direction the PCV valve 16 side. Accordingly, if the oil separator 12 receives an inertia force due to a sudden stop of the vehicle or if the engine tilts, for example, when the vehicle is running on a downhill slope, and, therefore, the oil in the oil separator 12 starts flowing toward the front side of the vehicle, the flow of the oil toward the front side of the vehicle is blocked by the rib 12*d*, and the oil is held and collected in the dead-end portion 19 until the oil level exceeds the upper end of the rib 12*d*. As a result, it is possible to prevent the situation where the oil in the oil separator 12 enters the intake manifold of the engine and is burned in the engine and white smoke is then produced.

When the oil separator 12 is arranged in a space narrow in the vertical direction, at a position between the two banks 11*a* and below the surge tank 17, the oil separator 12 is short in height and flat. Accordingly, with the conventional structure, if an engine is tilted forward, the oil on the floor of an oil separator overflows the side wall of the oil separator and easily enters a PCV valve. However, when the rib 12*d* forms the dead-end portion 19 as according to the embodiment of the invention, it is possible to prevent the oil in the oil separator 12 from flowing into the PCV valve 16. As a result, the disadvantages of the flat oil separator 12 are reduced.

In addition, because the first floor wall portion 12*a*(1), which is closer to the oil discharge hole 15 than the rib 12*d* is, is level with or lower than the second wall portion 12*a*(2), which is closer to the PCV valve 16 than the rib 12*d* is, the oil that has been separated from the gas in the oil separator 12 and liquefied, flows into the first floor wall portion 12*a*(1), efficiently flows from the first floor wall portion 12*a*(1) to the oil discharge hole 15, and is finally returned to the oil pan of the engine. Also, because the first floor wall portion 12*a*(1) is lower than the other floor portion, the oil level is low with respect to the upper end of the rib 12*d*. Accordingly, even if the oil separator 12 receives an inertia force due to a sudden stop of the vehicle or if the engine tilts, for example, when the vehicle is running on a downhill slope, and, therefore, the oil in the oil separator 12 starts flowing toward the front side of the vehicle, it is difficult to for the oil to overflow the rib 12*d*.

In addition, the communication passage 21 is formed between the end portion of the rib 12*d* at which the dead-end portion 19 is open and the side wall 12*c* which faces the end portion, and the guide rib 12*h*, which guides the oil flowing on the floor toward the communication passage 21, is formed at a position closer to the blowby gas inlet 18 than the communication passage 21 is. Accordingly, the oil, present on the upstream of the guide rib 12*b* in the direction in which the blowby gas flows, is efficiently guided to the communication passage 21 by the guide rib 12*h*, and then introduced to the oil discharge passage 15 through the communication passage 21. Because the guide rib 12*h* is shorter than the rib 12*d* in height, the flow of the blowby gas is not blocked.

When the new air introduction passage 23 is connected to the oil return passage 22 connected to the oil discharge hole 15, the new air in the cylinder head cover is introduced into the oil separator 12 through the oil discharge hole 15, the NOx concentration in the blowby gas in the oil separator 12 is reduced, and formation of sludge due to reaction of the oil with NOx is suppressed. As a result, formation of sludge is suppressed efficiently, as compared with the case where the new air is not introduced into the oil separator 12.

Because the oil return passage 22 connected to the oil discharge hole 15 is provided with the container portion 24, even if the amount of blowby gas is great and the oil starts flowing back from the oil return passage 22 into the oil separator 12 through the oil discharge hole 15, the backflow of the oil is efficiently absorbed in the container portion 24, and, consequently, the oil is prevented from flowing back to the oil separator 12. In addition, the structure is such that the new air from the two banks 11*a* of the V-type engine 11 is introduced into the new air introduction passage 23. This structure matches the arrangement of the oil separator 12 between the two banks 11*a*, and the new air from the two banks 11*a* is easily introduced into the oil separator 12.

The invention claimed is:

1. A PCV system for a V-type engine, comprising:

a PCV valve;

an oil separator that has an oil discharge hole and is connected to the PCV valve; and an oilmist extraction port that is formed at a position corresponding to a center of a top portion of a chain case of the engine with respect to a lateral direction of the chain case, and the oilmist extraction portion is configured to guide oilmist from the chain case to the oil separator, wherein the PCV valve is used to return blowby gas, which has been separated from liquid in the oil separator, to an intake system of the engine, and the PCV valve is provided at an end portion of the oil separator, the end portion being on a chain case side.

2. The PCV system according to claim 1, wherein the oil separator is arranged at a position between right and left banks of the V-type engine and below a surge tank, and an inlet, through which the oilmist from the oilmist extraction port is introduced into the oil separator, is formed at the end portion of the oil separator.

3. The PCV system according to claim 1, wherein the oil discharge hole is used to return oil, which has been separated from gas and liquefied in the oil separator, to the engine, and the oil discharge hole is formed in another end portion of the oil separator, the other end portion being on an opposite side of the chain case.

4. The PCV system according to claim 1, wherein the oil separator has a floor wall, a rib, which extends from the floor wall of the oil separator toward a wall opposite to the floor wall, is arranged inside the oil separator, the rib forms a dead-end portion that is open in a direction opposite to a direction toward a PCV valve side, and forms a dead-end in the direction toward the PCV valve side, and the dead-end portion holds back oil flowing on the floor wall of the oil separator toward the PCV valve side when the engine is tilted in a manner in which an end of the oil separator, at which the PCV valve is arranged, is lower than the other end of the oil separator.

5. The PCV system according to claim 4, wherein a communication passage, through which the oil that has been separated from gas and liquefied in the oil separator flows to the oil discharge hole, is formed between an end portion of the rib, at which the dead-end portion is open, and a side wall of the oil separator, which faces the end portion, and a guide rib, which guides the oil that has been separated from the gas and liquefied in the oil separator to the communication passage, is arranged at a position closer to the oilmist extraction port than the communication passage is.

6. The PCV system according to claim 1, wherein the oil separator has a floor wall, the floor wall of the oil separator has a first floor wall portion that is close to the oil discharge hole and a second floor wall portion that is close to the PCV valve, and the first floor wall portion is level with or lower than the second floor wall portion.

7. The PCV system according to claim 6, wherein a communication passage, through which the oil that has been separated from gas and liquefied in the oil separator flows to the oil discharge hole, is formed between an end portion of the rib, at which the dead-end portion is open, and a side wall of the oil separator, which faces the end portion, and a guide rib, which guides the oil that has been separated from the gas and liquefied in the oil separator to the communication passage, is arranged at a position closer to the oilmist extraction port than the communication passage is.

8. The PCV system according to claim 1, wherein an air introduction passage is connected to an oil return passage connected to the oil discharge hole.

9. The PCV system according to claim 8, wherein air from the two banks of the V-type engine is introduced in the air introduction passage.

10. A PCV system for a V-type engine, comprising:

a PCV valve;

an oil separator that has an oil discharge hole and is connected to the PCV valve;

an oilmist extraction port that is formed at a position corresponding to a center of a top portion of a chain case of the engine with respect to a lateral direction of the chain case, and through which oilmist to be supplied to the oil separator is taken out from the engine; and an oil return passage that connects the oil discharge hole and the engine, the oil return passage being provided with a container portion;

wherein the oil separator is arranged at a position between right and left banks of the V-type engine and below a surge tank, and an inlet, through which the oilmist from the oilmist extraction port is introduced into the oil separator, is formed at an end portion of the oil separator.

11. A PCV system for a V-type engine, comprising:

a PCV valve;

an oil separator that has an oil discharge hole and is connected to the PCV valve;

an oilmist extraction port that is formed at a position corresponding to a center of a top portion of a chain case of the engine with respect to a lateral direction of the chain case, and through which oilmist to be supplied to the oil separator is taken out from the engine; and an oil return passage that connects the oil discharge hole and the engine, the oil return passage being provided with a container portion;

wherein the oil discharge hole is used to return oil, which has been separated from gas and liquefied in the oil separator, to the engine, and the oil discharge hole is formed in an end portion of the oil separator, the end portion being on an opposite side of the chain case.

12. A PCV system for a V-type engine, comprising:

a PCV valve;

an oil separator that has an oil discharge hole and is connected to the PCV valve;

an oilmist extraction port that is formed at a position corresponding to a center of a top portion of a chain case of the engine with respect to a lateral direction of the chain case, and through which oilmist to be supplied to the oil separator is taken out from the engine; and an oil return passage that connects the oil discharge hole and the engine, the oil return passage being provided with a container portion;

wherein the oil separator:

floor wall, a rib, the rib extending from the floor wall of the oil separator toward a wall opposite to the floor wall, being arranged inside the oil separator, forming a dead-end portion that is open in a direction opposite to a direction toward a PCV valve side, and forming a dead-end in the direction toward the PCV valve side, and the dead-end portion holding back oil flowing on the floor wall of the oil separator toward the PCV valve side when the engine is tilted in a manner in which an end of the oil separator, at which the PCV valve is arranged, is lower than the other end of the oil separator.

13. The PCV system according to claim 12, further comprises;

a communication passage, through which the oil that has been separated from gas and liquefied in the oil separator flows to the oil discharge hole, formed between an end portion of the rib, at which the dead-end portion is open, and a side wall of the oil separator, which faces the end portion, and a guide rib, which guides the oil that has been separated from the gas and liquefied in the oil separator to the communication passage, arranged at a position closer to the oilmist extraction port than the communication passage.

14. A PCV system for a V-type engine, comprising:

a PCV valve;

an oil separator that has an oil discharge hole and is connected to the PCV valve;

an oilmist extraction port that is formed at a position corresponding to a center of a top portion of a chain case of the engine with respect to a lateral direction of the chain case, and through which oilmist to be supplied to the oil separator is taken out from the engine; and an oil return passage that connects the oil discharge hole and the engine, the oil return passage being provided with a container portion;

wherein the oil separator has a floor wall, the floor wall having a first floor wall portion that is close to the oil discharge hole and a second floor wall portion that is close to the PCV valve, and the first floor wall portion being level with or lower than the second floor wall portion.

15. The PCV system according to claim 14, further comprises:

a communication passage, through which the oil that has been separated from gas and liquefied in the oil separator flows to the oil discharge hole, formed between an end portion of the rib, at which the dead-end portion is open, and a side wall of the oil separator, which faces the end portion, and a guide rib, which guides the oil that has been separated from the gas and liquefied in the oil separator to the communication passage, arranged at a position closer to the oilmist extraction port than the communication passage.

16. A PCV system for a V-type engine, comprising:

a PCV valve;

an oil separator that has an oil discharge hole and is connected to the PCV valve;

an oilmist extraction port that is formed at a position corresponding to a center of a top portion of a chain case of the engine with respect to a lateral direction of the chain case, and through which oilmist to be supplied to the oil separator is taken out from the engine;

an oil return passage that connects the oil discharge hole and the engine, the oil return passage being provided with a container portion, and an air introduction passage that is connected to the oil return passage.

17. The PCV system according to claim 16, wherein air from the two banks of the V-type engine is introduced in the air introduction passage.

* * * * *